US006364527B1

(12) United States Patent
Kutschera

(10) Patent No.: US 6,364,527 B1
(45) Date of Patent: Apr. 2, 2002

(54) ROTATING BULB X-RAY RADIATOR

(75) Inventor: Wolfgang Kutschera, Aurachtal (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 09/437,519

(22) Filed: Nov. 10, 1999

(30) Foreign Application Priority Data

Nov. 10, 1998 (DE) ..... 198 51 853

(51) Int. Cl.[7] ..... H01J 35/10

(52) U.S. Cl. ..... 378/200; 378/199; 378/127; 378/141; 378/205

(58) Field of Search ..... 378/200, 199, 378/127, 141, 121, 117, 118

(56) References Cited

U.S. PATENT DOCUMENTS 3,992,633 A * 11/1976 Braun et al.
5,703,926 A * 12/1997 Bischof ..... 378/200

* cited by examiner

*Primary Examiner*—Robert H. Kim
*Assistant Examiner*—Pamela R. Hobden
(74) *Attorney, Agent, or Firm*—Schiff Hardin & Waite

(57) ABSTRACT

A rotating bulb x-ray radiator has an x-ray tube accepted in a housing filled with a coolant, the x-ray tube being torsionally connected to the housing and being mounted so as to be rotatable together therewith. The housing is at least partially formed of a material that is highly attenuating for x-rays.

3 Claims, 1 Drawing Sheet

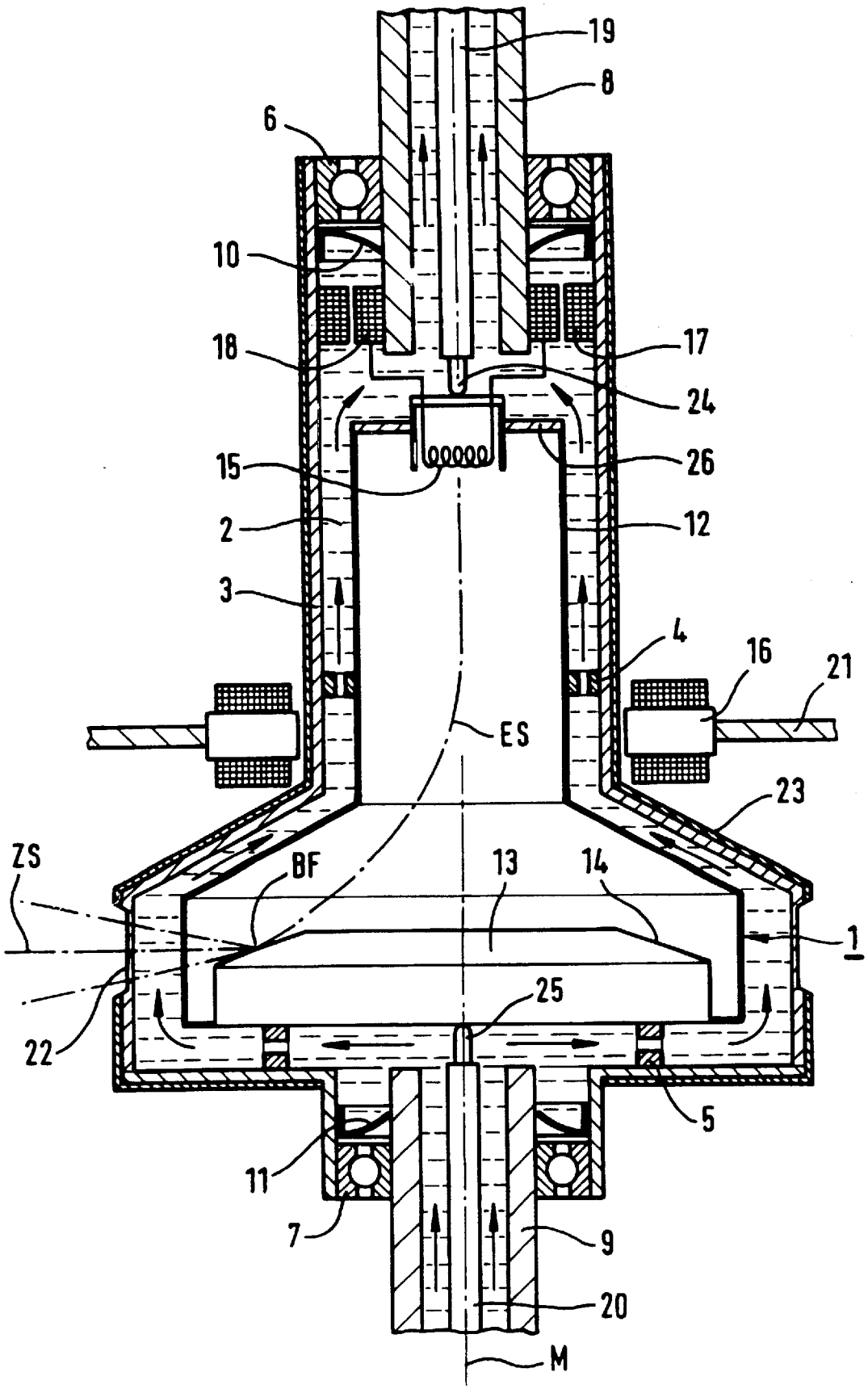
19
8
6
10
18
17
24
15
26
2
12
3
4
16
21
ES
23
ZS
BF
13
14
1
25
22
5
11
7
9
20
M

ROTATING BULB X-RAY RADIATOR

BACKGROUND OF THE INVENTION

1. Field of the Invention

The present invention is directed to a rotating bulb x-ray radiator of the type having an x-ray tube accepted in a housing filled with a coolant, the x-ray tube being torsionally (co-rotatably) connected to a rotatably mounted housing.

2. Description of the Prior Art

Such a rotating bulb radiator is disclosed, for example, in German OS 196 12 698, corresponding to U.S. Pat. No. 5,703,926. For radiation protection, the housing is surrounded by a fluid-filled, outer housing which is stationary relative to the housing that contains the x-ray tube, substantial outlay being associated with such a structure.

SUMMARY OF THE INVENTION

An object of the present invention is to provide a rotating bulb x-ray radiator of the above type which is more simply and economically constructed than known radiators of this type.

This object is achieved in accordance with the invention in a rotating bulb x-ray radiator having an x-ray tube contained in a housing filled with a coolant, the x-ray tube being torsionally (co-rotatably) connected to the housing and thus being rotatable together with the rotatably mounted housing, and wherein the housing is at least partially formed of a material which highly attenuates x-rays.

Thus no additional, outer housing is required in the inventive radiator, since the housing containing the coolant is already fashioned as a radiation protection housing. As a result thereof, the fluid friction which is present in conventional radiators between the rotating housing containing the x-ray tube and the fluid contained in the outer housing is eliminated, so that the drive power required for the rotation of the housing with the x-ray tube is reduced.

In order to assure the required electrical insulation, the housing in a version of the invention is at least partially formed of electrically insulating material.

An especially simple structure of the inventive rotating bulb x-ray radiator is obtained in an embodiment wherein the rotatable bearing of the housing together with the x-ray tube is accomplished by rotatably mounting at least one side of the housing on a hollow shaft in conductive fluid communication with the housing. Then the delivery or discharge of the coolant can ensue through the hollow shaft in a simple way.

DESCRIPTION OF THE DRAWINGS

The single FIGURE is a schematic illustration of an inventive rotating bulb x-ray radiator, in longitudinal section.

DESCRIPTION OF THE PREFERRED EMBODIMENTS

The inventive rotating bulb x-ray radiator has an x-ray tube 1 that is accepted in a housing 3 filled with a fluid coolant 2 in the case of the exemplary embodiment, and torsionally connected thereto. The x-ray tube 1 and the housing 3 are substantially rotationally symmetric with reference to a middle axis M and are mounted to be rotatable around the middle axis M.

The torsional connection between the x-ray tube 1 and the housing 3 is produced by a number of connector parts 4, 5 that also function as spacers between the x-ray tube 1 and the housing 3.

For rotatably mounting the x-ray tube 1 and of the housing 3 with reference to the middle axis M, these components are respectively mounted on hollow shafts 8, 9 at both sides, preferably with commercially obtainable roller bearings 6, 7. Seal rings 10, 11 are provide for sealing, these preferably being commercially obtainable seal rings.

The hollow shafts 8, 9 discharge into the interior of the housing 2, so that the hollow shafts 8, 9 represent a conductive fluid connection to the interior of the housing 3 and enable a flow of the coolant, for example in a cooling circulation path, indicated by arrows.

As can be seen from the FIGURE, the x-ray tube 1 has a vacuum housing 12 that has one end provided with a dish-shaped anode 13 having a conical frustum-shaped incident surface 14 on which electron beam ES strikes in a focal spot BF, so that x-rays emanate from the focal spot BF. Only the central x-ray ZS and two margin x-rays are shown dot-dashed in the FIGURE.

The electron beam ES emanates from a cathode 15 arranged inside the vacuum housing 12 on the middle axis M. The electron beam ES is deflected such with a deflection system 16 that is torsionally and stationarily attached to a carrier 21 relative to the x-ray tube 1 and to the housing 3. The deflection system 16 is preferably an electromagnetic deflection system. The deflection system 16 deflects the electron beam ES so that, despite the rotation of the x-ray tube 1 and the housing 3, the electron beam ES strikes in the stationary focal spot BF on the incident surface 14 of the anode 13. The deflection system 16 is preferably a quadrupole system of the type known in conjunction with rotating bulb x-ray radiators.

The filament current for the cathode 15 is supplied via a transformer which is schematically indicated in the FIGURE, this comprising a stator connected to the hollow shaft 8 and a rotor 18 connected to the housing 3. The rotor 18 alternatively can be connected to the vacuum housing 12 as needed.

The high-voltage required in addition to the filament current for the operation of the x-ray tube 1 is supplied by two-high voltage leads 19, 20 that extend through the hollow shafts 8, 9 and, for example, are in electrically conductive communication with the cathode, which is electrically insulated from the anode 13 by an insulator 26, and with the anode 13 via respective contact pins 24, 25 provided at their ends.

The wall of the vacuum housing 12 is so thin that it can be penetrated by the x-radiation emanating from the focal spot BF without significant attenuation, the housing 3 being formed of an electrically insulating material and having an annular region 22 of reduced wall thickness that functions as abeam exit window.

In order to achieve the required radiation protection, the exterior of the housing 3 beyond the region 22 is coated with a layer 23 of a material that his highly attenuates x-rays, for example lead. A material having a highly attenuating effect for x-ray means is a material having an atomic number higher than 19.

Coating of the housing 3 can be omitted at its wall immediately adjacent to the anode 13, insofar as the anode 13 itself offers adequate radiation protection.

The flow direction of the coolant, that is preferably a fluid, namely insulating oil, as shown in the exemplary embodiment, is preferably selected, as indicated by the direction of the arrows in the FIGURE, so that the coolant flows into the housing 3 through the hollow shaft 9 adjacent to the anode 13 and flows out therefrom through the hollow shaft 8.

In addition to the important advantage of the invention that no special radiation protection housing is required, the invention offers the following, further advantages:

As a result of the fact that the housing 3 that contains the coolant rotates in common with the x-ray tube 1, no frictional losses due to rotation of the x-ray tube 1 in the coolant occur. Accordingly, a significantly lower drive power can be employed, only as is necessary to overcome the friction of the roller bearings 6, 7 and the seal rings 10, 11.

Since the seal rings 10, 11 are arranged such that the roller bearings 6, 7 are located outside the coolant, these can be operated with grease lubrication thereby avoiding all know problems that occur when ball bearings run in insulating oil.

As noted above, in the exemplary embodiment, the coolant is a liquid; instead, however, a suitable gas can also be employed.

Hollow shafts need not necessarily be used. Solid shafts can also be employed.

Differing from the described exemplary embodiment, further, a single-sided support of x-ray tube and housing is also possible.

The above-described manner by which the currents and voltages required for the operation of the x-ray tube are supplied is only an example.

The structure of the x-ray tube 1 itself is also only exemplary. In particular, x-ray tubes can also be utilized wherein the cathode, differing from the described exemplary embodiment, is not arranged on the middle axis but is eccentrically seated relative to the middle axis of the x-ray tube and is maintained stationary with suitable devices.

Although modifications and changes may be suggested by those skilled in the art, it is the intention of the inventor to embody within the patent warranted hereon all changes and modifications as reasonably and properly come within the scope of his contribution to the art.

I claim as my invention:

1. An x-ray radiator comprising:

a rotating bulb x-ray tube;

a housing in which said x-ray tube is contained, and said housing being otherwise filled with a coolant;

said x-ray tube being torsionally connected to said housing and said x-ray tube and said housing being rotatably mounted so as to be rotatable in common; and said housing being at least partially composed of a material which highly attenuates x-rays.

2. An x-ray radiator as claimed in claim 1 wherein said housing is at least partially formed of an electrically insulating material.

3. An x-ray radiator as claimed in claim 1 further comprising a hollow shaft, on which said housing is rotatably mounted, said hollow shaft being in fluid communication with an interior of said housing for allowing flow of said coolant through said hollow shaft.

* * * * *